United States Patent [19]

Weigele et al.

[11] 4,284,005

[45] Aug. 18, 1981

[54] APPARATUS FOR THE METERED FEEDING OF INK TO A DUCTOR ROLL OF AN OFFSET PRINTING DEVICE

[75] Inventors: Reinhold Weigele, Korntal; Wolfgang Pfeil, Kornwestheim; Horst Purr, Tennenbronn, all of Fed. Rep. of Germany

[73] Assignee: Develop Dr. Eisbein GmbH & Co., Gerlingen, Fed. Rep. of Germany

[21] Appl. No.: 18,918

[22] Filed: Mar. 9, 1979

[30] Foreign Application Priority Data

Mar. 15, 1978 [DE] Fed. Rep. of Germany ..... 2811276

[51] Int. Cl.[3] ..... B41F 31/08

[52] U.S. Cl. ..... 101/363; 101/366

[58] Field of Search ..... 101/350, 356, 363, 364, 101/366; 417/547

[56] References Cited

U.S. PATENT DOCUMENTS

| | | | |
|---|---|---|---|
| 3,373,052 | 3/1968 | Rode | 101/363 X |
| 3,384,013 | 5/1968 | Kim et al. | 101/350 |
| 3,556,008 | 1/1971 | Branfield et al. | 101/350 |
| 3,584,579 | 6/1971 | Rothenberg | 101/350 |
| 3,589,288 | 6/1971 | Lake | 101/363 |
| 3,730,089 | 5/1973 | McCutcheon | 101/363 |
| 3,901,150 | 8/1975 | Kirby | 101/363 X |
| 3,987,727 | 10/1976 | Thatcher | 101/366 |
| 4,010,683 | 3/1977 | Lambert et al. | 101/366 |
| 4,066,014 | 1/1978 | van Haaften | 101/366 X |

OTHER PUBLICATIONS

Phillips, IBM Tech. Discl. Bulletin, vol. 16, No. 10, Mar. 1974, pp. 3293-3294.

*Primary Examiner*—Edward M. Coven
*Attorney, Agent, or Firm*—Craig and Antonelli

[57] ABSTRACT

An apparatus for a metered feeding of ink to a ductor roll of an offset printing device. The ductor roll is adapted to be dipped into an ink pool which is connected to a device for supplying metered amounts of ink. The device for supplying the metered amounts of ink is controlled by an installation for monitoring a level of ink in the ink pool. The monitoring installation includes a distance sensor which is constructed as a capacitive proximity switch.

11 Claims, 3 Drawing Figures

APPARATUS FOR THE METERED FEEDING OF INK TO A DUCTOR ROLL OF AN OFFSET PRINTING DEVICE

The present invention relates to an offset printing arrangement and, more particularly, to an apparatus for a metered feeding of ink to a ductor roll of an offset printer, with the ductor roll being adapted to be dipped into an ink pool connected to a device for adding metered amounts of ink which device is controlled by an installation for monitoring the level of the ink pool by means of a distance sensor.

In offset printing devices, metered feeding of printing ink causes considerable difficulties under practical operating conditions. Above all, this is due to the fact that the printing ink is, on the one hand, relatively viscous and has approximately the viscosity of honey and, on the other hand, the printing ink is not electrically conductive so that measuring probes which operate on electrical or inductive principles cannot readily be utilized.

In large-scale commercial offset printing machines, it has been proposed to monitor the ink reservoir level by means of a reflex air switch and feed ink in dependence on the monitored ink level when required. A disadvantage of such proposed construction resides in the fact that reflex air switches are relatively prone to trouble and they do not function any longer once the switches are immersed in the ink bath. In particular, the openings conveying the reflex air jet become clogged so that the reflex air switch must first be cleaned before being returned to operation. Moreover, the pneumatic signal obtained from the reflex air switch must be converted to an electric signal prior to being utilized as a control signal for an ink feeding device. Consequently, such proposed installations become rather expensive so that their use in a small offset printing device, especially the so-called office printers, is too costly and impractical.

In small offset printers used in general offices, no apparatus has yet been proposed for a metered feeding of ink which is really operable under practical conditions so that a correct addition of ink has, to date, been largely left to the skill of the person operating the offset printer. As can be appreciated, in practice, this has caused considerable difficulties since offset printing installations show an extremely sensitive reaction to overdosing or lack of ink.

Moreover, with small offset printers, an especially disadvantageous aspect resides in the fact that the ink reservoirs associated with the ductor rolls must be relatively small in the small-scale machines; however, during a larger printing job ink depletion from the ink reservoir can occur relatively rapidly.

The aim underlying the present invention essentially resides in providing an apparatus for a metered feeding of ink which operates safely and reliably and can be manufactured at low commercial costs so that the apparatus may be utilized in connection with small offset printing devices.

In accordance with one feature of the present invention, the level of ink in the ink pool is monitored by way of a distance sensor constructed as a capacitive proximity switch.

By virtue of the use of a capacitive proximity switch in accordance with the present invention, the switch is not dependent on the electric conductivity of the ink so that the switch responds or provides an output signal even in the case of electrically non-conductive printing ink. Additionally, by virtue of the utilization of a proximity switch, the functioning or operability thereof is not impaired if the switch is dipped at times into the ink in the ink pool since the switch is not susceptible to such disturbances.

In accordance with further advantageous features of the present invention, the proximity switch is associated with a zone of the ink pool wherein the ink forms a bead while the ductor roll is in operation. As soon as the ductor roll commences a rotation, it has been observed that a bead forms in the immediate vicinity of the ductor roll. The bead, especially in small devices with a correspondingly small volume of the ink pool, is susceptible to great change in level which, according to the present invention, is utilized for preventing faulty metering of the ink.

In accordance with yet further features of the present invention, the proximity switch may be arranged centrally between two ink feeding nozzles which are arranged at a mutual spacing corresponding at least approximately to half of the length of the ductor roll. The advantage of utilizing two ink feeding nozzles resides in the fact that relatively large cross-sections can be employed resulting in a construction which is insensitive to clogging by drying of the ink or the like. However, it is also possible in accordance with the present invention, to arrange the feeding nozzles so that they are practically constantly immersed in the ink pool thereby also preventing a drying of the ink in the region of the ink feeding nozzles.

In order to result in a minimizing of the manufacturing expenses of the entire installation, it is also possible in accordance with the present invention, to provide an exhangeable cartridge which serves as a metering pump with the cartridge including a plunger which can be advanced stepwise by an automatic advance means by a predetermined distance. An advantage in the use of the cartridge resides in the fact that the ink supply can be supplemented by simply replacing the cartridge which could be executed in a very simple manner even by unskilled personnel without the danger of the ink being spilled on either the person or the apparatus.

To provide a simple advancing means, in accordance with yet further features of the present invention, the automatic advance means includes a plunger stem held by means of a detent with the stem being connectable to the plunger of the cartridge and being connected to an advance drive mechanism. In this connection, conventional devices can be utilized in a particularly simple manner such as, for example, advancing devices as used with caulking guns for spreading of sealing compound or the like with the only change necessary being the interconnection of the automatic advance in place of the manual actuation as occurs with conventional caulking guns.

To prevent a destruction or breaking of the automatic advance after the contents of the cartridge have been used up, in accordance with a further development of the present invention, a limit switch, acting on the advance drive mechanism, is associated with the plunger stem which limit switch is responsive to the plunger stem reaching an extreme advancement position.

Since the proximity switch measures the level of ink in the ink pool in the region of the bead formed in the immediate vicinity of the ductor roll, the feeding of ink is to be triggered only after the bead has been formed. For this reason, advantageously, according to the present invention, a control unit for the automatic advance drive mechanism, which is connected to the proximity switch, is equipped with a timer element which releases the signal of the proximity switch for evaluation only after a time delay following the turning on of the device.

In accordance with the present invention, the timer element may be suitably adjusted so that the signal of the proximity switch can be evaluated only after a time period of, for example, thirty seconds, since in such case the possibility is excluded of feeding ink at a time when only a small batch of, for example, ten prints is to be prepared.

Accordingly, it is an object of the present invention to provide an apparatus for a metered feeding of ink to a ductor roll of an offset printing device which avoids, by simple means, shortcomings and disadvantages encountered in the prior art.

Another object of the present invention resides in providing an apparatus for a metered feeding of ink to a ductor roll of an offset printing device which precisely measures the level of ink in an ink reservoir so as to avoid an oversupply or lack of adequate supply of ink to the ductor roll.

Yet another object of the present invention resides in providing an apparatus for a metered feeding of ink to a ductor roll of an offset printing device wherein a sensing of the level of ink in an ink reservoir is not dependent upon the conductivity of the ink.

A still further object of the present invention resides in providing an apparatus for a metered feeding of ink to a ductor roll of an offset printing device which is simple in construction and therefore inexpensive to manufacture.

Yet another object of the present invention resides in providing an apparatus for a metered feeding of ink to a ductor roll of an offset printing device which functions reliably under all operating conditions.

These and other objects, features, and advantages of the present invention will become more apparent from the following description when taken in connection with the accompanying drawings which show, for the purposes of illustration only, one embodiment in accordance with the present invention, and wherein.

Figure 1:
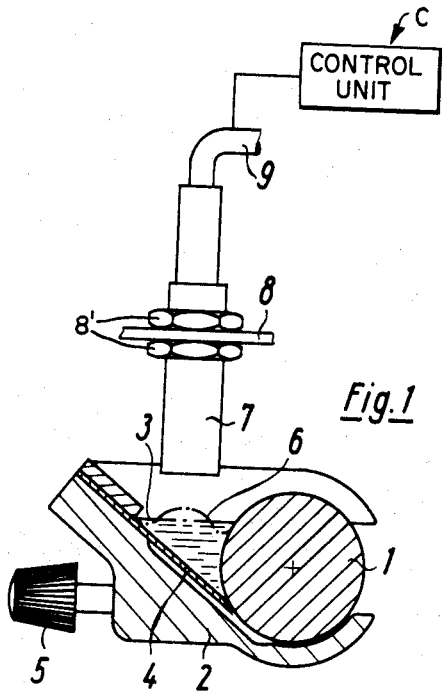
FIG. 1 is a partially schematic cross-sectional view of an apparatus in accordance with the present invention arranged in a zone of a ductor roll of a small offset printing device.

Referring now to the drawings wherein like reference numerals are used throughout the various views to designate like parts and, more particularly, to FIG. 1, according to this figure, a ductor roll 1 rotates in a trough 2 having an inclined inner wall with ink being accommodated into a wedge-shaped gap between the inclined inner wall of the trough 2 and the ductor roll 1 so as to form an ink pool. In a rest position, the ink in the ink pool has a level indicated by the straight dot-dash line 3. Blades 4, associated with the ductor roll 1, are mounted at the trough 2 with a contact pressure of the blades 4 against the ductor roll 1 being adjustable, in a conventional manner, by means of a plurality of set screws 5. By virture of the set screws 5 and the blades 4, the amount of ink entrained by the ductor roll 1 may be adjusted. The peripheral region of the ductor roll 1 facing away from the inclined inner wall of the trough 2 is open or uncovered with this peripheral surface being associated, during a normal printing operation, with an ink transfer roll (not shown) in a conventional manner.

When the ductor roll 1 is driven in, for example, a counter-clockwise direction in FIG. 1, the ink level in the ink pool in the trough 2 changes. More particularly, it has been found that due to a low viscosity of the ink, a bead, indicated by the curved dot-dash line 6, is formed in the zone of the ductor roll. The bead 6 attains a full size after three or four revolutions of the ductor roll and thereafter remains constant in size.

A capacitive proximity switch 7 is provided for monitoring the amount of ink in the approximately wedge-shaped zone formed by the inner wall of the trough 2 and the ductor roll 1. The capacitive proximity switch 7 is fixedly attached at an accurately set vertical position to a holding plate 8. For this purpose, as shown in FIG. 1, conventional fasteners such as threaded nuts 8' or the like may be provided and cooperate with, for example, a threaded portion of the capacitive proximity switch 7 so as to permit a precise or fine vertical adjustment relative to the level of ink in the ink pool as well as to fix the switch 7 in the adjusted position. The capacitive proximity switch 7 is connected by way of an electrical line 9 to a conventional control unit generally designated by the reference character C which control unit C is operatively connected with a metering pump generally designated by the reference character P (FIG. 3).

When the proximity switch 7 detects a lack of ink in the ink reservoir or an insufficient level of ink, the control unit C provides an output signal to the metering pump P so as to activate or turn the pump P on. The pump P conducts the ink by way of distributor lines generally designated by the reference numeral 11 to two tubular ink feeding nozzles 12 (FIG. 2) oriented from above onto a center of the wedge-shaped space defined between the inner wall of the trough 2 and the ductor roll 1.

Figure 2:
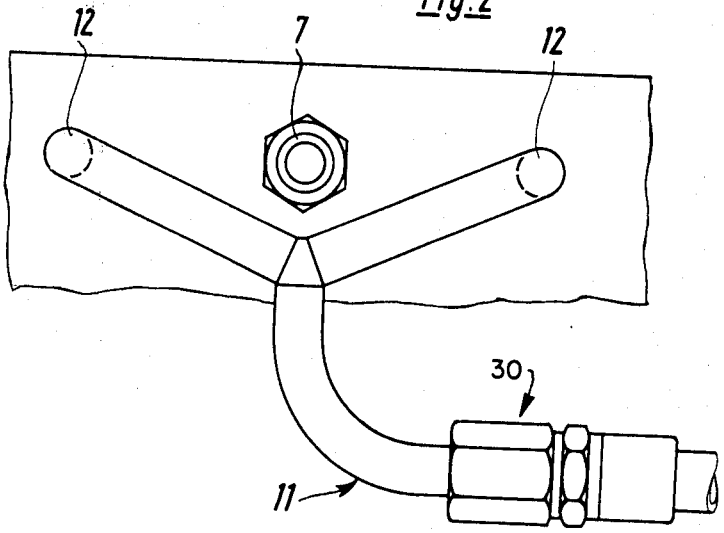
FIG. 2 is a partial plan view of the apparatus of FIG. 1.

As shown in FIG. 2, the two ink feeding nozzles 12 are disposed at equal distances from the capacitive proximity switch 7 with the mutual spacing of the nozzles 12 corresponding approximately to one-half of the axial length of the ductor roll 1. The capacitive proximity switch 7 is arranged above the bead 6 approximately in a center of the axial length of the ductor roll 1 so that the two ink feeding nozzles 12 are disposed approximately at a spacing of one-fourth of the length of the ductor roll 1 with respect to the end of the ductor roll 1.

Figure 3:
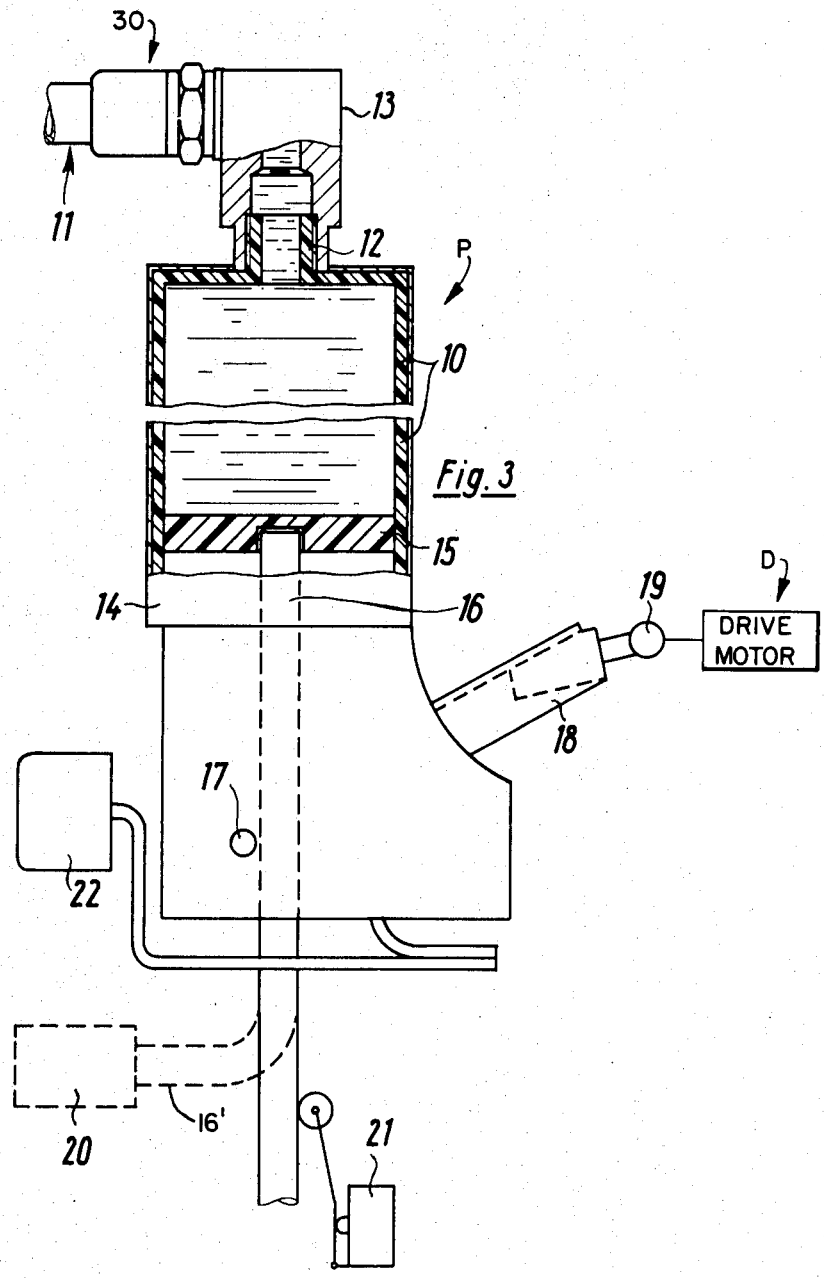
FIG. 3 is a partial cross-sectional view of a metering pump for the apparatus of FIGS. 1 and 2.

As shown in FIG. 3, the metering pump P includes an ink-filled plastic cartridge 10 threadably inserted, preferably in a vertical direction, by way of a threaded extension, having an opening, into a distributor member 13. The cartridge 10 is guided in, for example, a sheet metal housing 14. The housing 14 is laterally open so that the cartridge 10 can be inserted from the side thereof. The cartridge 10 has a plunger 15 which is adapted to be advanced by a plunger stem 16 in a stepwise manner by a predetermined distance with the plunger stem 16 being adapted to be locked in the respective stepwise positions.

The adjustment of the plunger stem 16 is effected by a lever 18 which is pivotable about an axle 17. The lever 18 is adapted to be pivoted upwardly and downwardly in the direction of motion of the plunger stem 16. As the lever 18 is pivoted downwardly, the plunger stem 16 is advanced by a predetermined distance and the lever 18 is then moved upwardly with the plunger stem 16 being fixed in the advanced position. The lever 18 is provided with a connecting means including, for example, a spherical head 19 which is adapted to be connected, in a conventional manner, with an electric drive motor generally designated by the reference character D by way of a connecting rod (not shown).

The electric drive motor D may, for example, be a conventional windshield wiper motor which is adapted to be actuated upon receipt of a control pulse from the control means C so that the drive motor D executes a full rotation whereby the lever 18 effects a complete upward and downward motion thereby advancing the plunger stem 16 and the plunger 15 by a predetermined distance.

The plunger stem 16 and the plunger 15 may be advanced stepwise until the plunger 15 reaches the end of the cartridge 10. The plunger stem 16, opposite the plunger 15, terminates in an angled end portion 16' having a handle 20 shown in dashed lines in FIG. 3. As the plunger 15 reaches the end of the cartridge 10, the angled end portion 16' of the plunger stem 16 is disposed above a limit switch 21 which is set, for example, so that in the position shown in FIG. 3, it maintains the current supply to the drive motor D. As soon as the plunger stem 16 has reached the position shown in dashed lines in FIG. 3, the limit switch 21 is opened or becomes non-conductive and interrupts the current supply to the drive motor D so that the drive motor D can no longer be actuated or turned on by a signal from the control unit C. If desired, the control unit C may provide an appropriate audible or visual signal to the operator that the cartridge 10 must be replaced. To replace the cartridge, it would be necessary for the plunger stem 16 to be pulled back to its starting position. For this purpose, the detent 22 acting on the locking plunger stem 16 must be actuated so as to release the plunger stem 16. The actuation of the detent 22 could be effected by an appropriate control signal from the control unit C. After the plunger stem 16 is pulled back to its starting position, the empty cartridge 10 may be exchanged for a full cartridge so that the apparatus is then again ready for normal operation.

To facilitate removal and cleaning, as shown in FIGS. 2 and 3, the distributor lines 11 are provided with screw couplings or connectors generally designated by the reference numeral 30 whereby the lines 11 can, if necessary, be removed in a relatively simple manner.

The control unit C acting on the drive motor D is connected to the capacitive proximity switch 7 by way of the electric line 9. The control unit C contains a timer element so as to insure that an evaluation of the signal received from the capacitive proximity switch 7 will at all times only take place after a predetermined time delay. The time delay is selected so that, on the one hand, the replenishing of the printing ink takes place only once the bead 6 attains its full size and, at such full size, remains far below the capacitive sensor so that the bead 6 leads then to a signal indicating an insufficient supply of ink in the ink reservoir. Moreover, the time delay element is set so that it triggers the feeding of ink from the pump P only at a time when the printing mechanism of the offset printer has been turned on for a predetermined length of time such as, for example, thirty seconds, so that an overdosing or oversupply of printing ink is safely excluded during the printing of a small quantity of items on the offset printer.

From a constructional viewpoint, it is important that the capacitive proximity switch 6, fashioned as a cylindrical pin, essentially responds only to changes in the distance occurring in an extension of the longitudinal axis of the sensor 7 oriented onto the bead 6. Thereby, it is possible to arrange the sensor 7 relatively closely beside the ductor roll 1, namely, at a spacing smaller than the possible switching distance between the capacitive proximity switch 7 and the bead 6.

While we have shown and described only one embodiment in accordance with the present invention, it is understood that the same is not limited thereto, but is susceptible to numerous changes and modifications as known to one having ordinary skill in the art, and we therefore do not wish to be limited to the details shown and described herein, but intend to cover all such modifications as are encompassed by the scope of the appended claims.

We claim:

1. An apparatus for metered feeding of ink to a revolvable ductor roll adapted to be dipped in an ink pool comprising:

pump means for supplying a metered amount of ink to said ink pool;

capacitive proximity sensor means for monitoring a level of ink in the ink pool and for providing a control signal to the pump means;

control means including timer means for delaying a delivery of said control signal from said capacitive proximity sensor means to said pump means until a predetermined time after the ductor roll begins a revolution;

wherein the capactive proximity sensor means is associated with an area of said ink bath where an ink bead forms upon revolution of the ductor roll, whereby a predetermined amount of ink is metered into said ink pool upon receipt of said control signal by said pump means.

2. An apparatus according to claim 1, wherein the pump means includes at least two nozzle means for feeding ink to the ink pool, and in that the capacitive proximity sensor means is arranged essentially between the two ink feeding nozzle means, the two ink feeding nozzle means are disposed at a mutual distance corresponding at least approximately to one-half an axial length of the ductor roll.

3. An apparatus according to claim 2, wherein exchangeable distributor line means are provided for operatively connecting the two ink feeding nozzle means to the pump means.

4. An apparatus according to claim 2, wherein the pump means includes an exchangeable cartridge means for accommodating a supply of ink, a plunger means is provided in the cartridge means for displacing the predetermined amount of ink from the cartridge means to the ink pool, and in that means are provided for automatically advancing the plunger means in a stepwise fashion by a predetermined distance.

5. An apparatus according to claim 4, wherein the means for automatically advancing the plunger means includes an advance drive means and an actuating plunger stem operatively connected with the plunger means and advance drive means, and in that detent means are provided for holding the actuating plunger stem in respective advanced positions.

6. An apparatus according to claim 5, wherein a limit switch means is provided for sensing a position of the plunger stem and for interrupting a drive of the advance drive means upon the plunger stem reaching an advanced position corresponding to an empty cartridge means.

7. An apparatus according to one of claims 4, 5 or 6, wherein the control means are operatively connected with the advance drive means and with the capacitive proximity sensor means.

8. An apparatus according to claim 1, wherein the pump means includes an exchangeable cartridge means for accommodating a supply of ink, a plunger means is provided in the cartridge means for displacing the predetermined amount of ink from the cartridge means to the ink pool, and in that means are provided for automatically advancing the plunger means in a stepwise fashion by a predetermined distance.

9. An apparatus according to claim 8, wherein the means for automatically advancing the plunger means includes an advance drive means and an actuating plunger stem operatively connected with the plunger means and the advance drive means, and in that detent means are provided for holding the actuating plunger stem in respective advanced positions.

10. An apparatus according to claim 9, wherein a limit switch means is provided for sensing a position of the plunger stem and for interrupting the drive of the advance drive means upon the plunger stem reaching an advanced position corresponding to an empty cartridge means.

11. An apparatus according to one of claims 8, 9, or 10, wherein the control means are operatively connected with the advance drive means and the capacitive proximity sensor means.

* * * * *